United States Patent [19]

Govaerts et al.

[11] Patent Number: 4,586,559

[45] Date of Patent: May 6, 1986

[54] PROCESS AND APPARATUS FOR CASTING A STRIP WITH LATERALLY EXTENDING LUGS

[75] Inventors: Marcel K. Govaerts, Olen; Hendrik A. L. Gielen, Kasterlee; John M. A. Dompas, Olen, all of Belgium

[73] Assignee: Hazelett Strip-Casting Corporation, Colchester, Vt.

[21] Appl. No.: 774,161

[22] Filed: Sep. 6, 1985

Related U.S. Application Data

[63] Continuation of Ser. No. 617,801, Jun. 6, 1984, abandoned, which is a continuation of Ser. No. 307,625, Oct. 1, 1981, abandoned.

[30] Foreign Application Priority Data

Jul. 9, 1981 [LU] Luxembourg ..... 83485

[51] Int. Cl.[4] ..... B22D 11/06; B22D 11/16; B22D 11/22

[52] U.S. Cl. ..... 164/455; 164/154; 164/432; 164/452; 164/481; 164/485

[58] Field of Search ..... 164/452, 454, 455, 481, 164/485, 154, 268, 431, 432

[56] References Cited

U.S. PATENT DOCUMENTS

| | | | |
|---|---|---|---|
| 3,860,057 | 1/1975 | Garlick | 164/481 |
| 3,865,176 | 2/1975 | Dompas et al. | 164/481 |
| 3,937,270 | 2/1976 | Hazelett et al. | 164/481 |
| 4,150,711 | 4/1979 | Hazelett et al. | 164/481 |

*Primary Examiner*—Nicholas P. Godici

*Assistant Examiner*—J. Reed Batten, Jr.

*Attorney, Agent, or Firm*—Parmelee, Bollinger & Bramblett

[57] ABSTRACT

An improved process and apparatus for casting a strip with laterally extending lugs by introducing molten metal at the inlet of a molding zone having a bottom and sidewalls, the bottom of the molding zone being formed by the upper surface of a moving endless belt and the sidewalls being formed by a first and second moving endless sidedam. The sidedams move with the belt from the inlet to the outlet of the molding zone and return from the outlet to the inlet. Each sidedam comprises an endless strap and a multiplicity of blocks strung thereon. Some of the blocks form lug molding pockets, the height of each pocket being lower than the height of the molding zone. A cast strip with laterally extending lugs is extracted at the outlet of the molding zone. The passage of lug molding pockets or blocks forming these pockets in each sidedam is detected. The difference between the temperatures of the first and the second sidedams is corrected so as to change the advancing speed of at least one of these dams, a warmer sidedam moving slower than a colder sidedam, if an unwanted lag is found between the molding pockets of the first sidedam and those of the second sidedam. The improvement comprises controlling the result of the correction measures by detecting the passage of the externally extending lugs in the cast product, modifying the correction as a function of the lug detection, and modifying the difference between the temperatures of the first and the second sidedams by use of cooling and heating units.

12 Claims, 9 Drawing Figures

PROCESS AND APPARATUS FOR CASTING A STRIP WITH LATERALLY EXTENDING LUGS

This is a continuation of application Ser. No. 617,801, filed on June 6, 1984, which is a continuation of Ser. No. 307,625, filed Oct. 1, 1981, both now abandoned.

BACKGROUND OF THE INVENTION

1. Technical Field

The present invention relates to a process and apparatus for casting a metal strip with laterally extending lugs.

2. Background Art

The conventional process for casting a strip with laterally extending lugs involves the following steps:

casting molten metal at the inlet of a molding zone, the bottom of the molding zone being formed by the upper run or surface of a moving endless belt and the sidewalls being formed by a first and a second moving endless sidedam, that move with the belt from the inlet to the outlet of the molding zone and that return outside the molding zone from the outlet to the inlet, each of these sidedams being composed of an endless strap and of a multiplicity of blocks strung thereon, some of these blocks forming lug molding pockets, the height of which are lower than that of the molding zone;

extracting a cast strip with laterally extending lugs at the outlet of the molding zone;

detecting the passage of lug molding pockets or of blocks forming these pockets on each sidedam; and correcting the difference between the temperature of the first and second sidedams so as to change the advancing speed of at least one of these dams, a warmer sidedam moving slower than a colder sidedam, if an unwanted lag is found between the molding pockets of the first sidedam and those of the second sidedam.

Such process is described in Belgian Pat. No. 870,907, (U.S. Pat. No. 4,150,711). In this known process, the passage of lug molding pockets or of lugs formed in these pockets is detected at a determined place, measures are taken as a function of the detected lag and one waits until these sidedams have made a complete revolution to check at the same place if the measures taken at the beginning of the revolution gave the expected synchronization of the revolution gave the expected synchronization of the sidedams.

The present inventors have found that no satisfying synchronization of the sidedams can be reached in this way. Moreover, this known process provides only cooling means to modify the difference between the temperature of the sidedams; hence no intervention is possible when any lag occurs at the beginning of a casting operation, since at that moment the sidedams are still cold, and no sufficient intervention is possible when an important lag occurs later on, when the sidedams are already warm. There is even a risk of introducing a wet sidedam in the molding zone. In this known process, lug molding pockets are formed by means of blocks, the bottom side of which, i.e. the side adjacent to the aforementioned belt in the molding zone, has a Tee slot in which the aforementioned strap is located. It has been found that such blocks quickly deteriorate.

DISCLOSURE OF THE INVENTION

Accordingly, it is an object of the present invention to provide a process which permits synchronized movement of the sidedams.

Another object is to provide improved blocks to form the lug molding pockets.

These and other objects of the present invention, as well as the advantages thereof, can be had by reference to the following disclosure and claims.

The foregoing objects are achieved according to the present invention by controlling the result of said correction by detecting the passage of the externally extending lugs on the cast product; modifying the correction as a function of said lug detection; and providing cooling and heating means for modifying the difference between the temperature of the first and the second sidedams.

As it is a feature of the invention, the blocks which form the lug molding pockets have bottom sides comprising continuous flat surfaces turned towards the endless belt.

The invention also deals with an apparatus for casting metal strip with lateral extending lugs having:

a molding zone having a bottom and sidewalls, the bottom of the molding zone being formed by the upper run or surface of a moving endless belt and the sidewalls being formed by a first and a second moving endless sidedam, adapted to move with the belt from the inlet to the outlet of the molding zone and to return outside the molding zone form the outlet to the inlet, each sidedam comprising an endless strap and a multiplicity of blocks strung thereon, some of these blocks forming lug molding pockets, the height of the molding pockets being lower than the height of the molding zone;

first means to detect the passage of lug molding pockets or of the blocks forming these pockets of each of the sidedams at a given point along their path;

second means to modify the difference between the temperature of the first and the second sidedam; and third means to made the first means act on the second means.

Such an apparatus is described in the above-mentioned Belgian Pat. No. 870,907 (U.S. Pat. No. 4,150,711). However, that known apparatus does not carry out the process of the present invention. The apparatus of the present invention which carries out the process of the present invention is characterized in that:

it has a fourth means to detect the passage of the lugs of the cast product and fifth means to make the fourth means act on the third means; and the second means comprises heating means and cooling means.

BRIEF DESCRIPTION OF THE DRAWINGS

Further features and advantages of the invention will be described in connection with the accompanying drawings, wherein.

For convenience of reference, the same structural elements are denoted throughout the drawings by the same numeral; letter suffixes are used to denote particular ones of those elements where necessary.

BEST MODE FOR CARRYING OUT THE INVENTION

Figure 1:
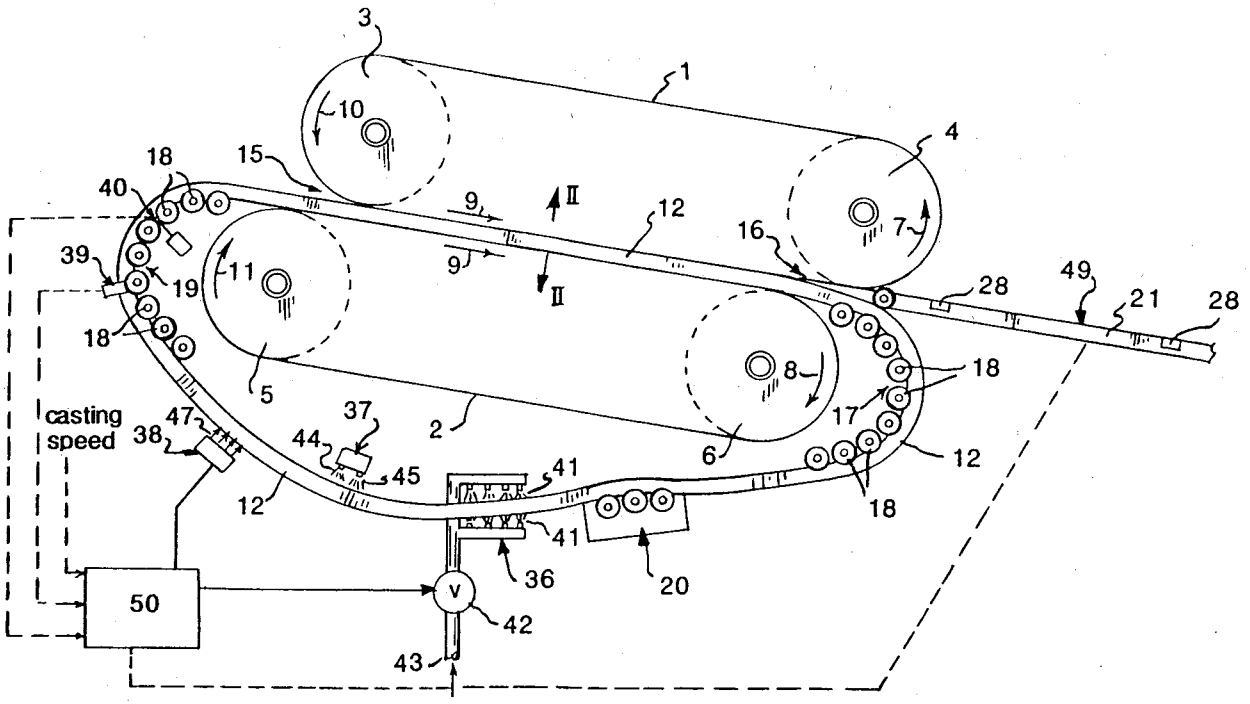
FIG. 1 is a partially schematic side elevational lateral view of an apparatus for continuous molding of a strip with lateral extending lugs, according to the invention.
Figure 2:
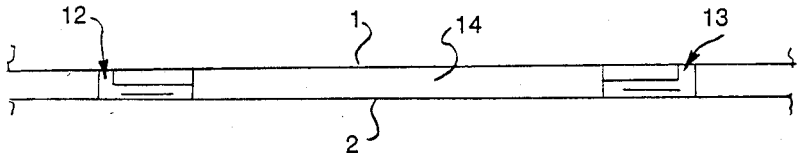
FIG. 2 is a schematic section through the apparatus of FIG. 1, taken through line II—II of FIG. 1 at a place where lugs are moulded.
Figure 3:
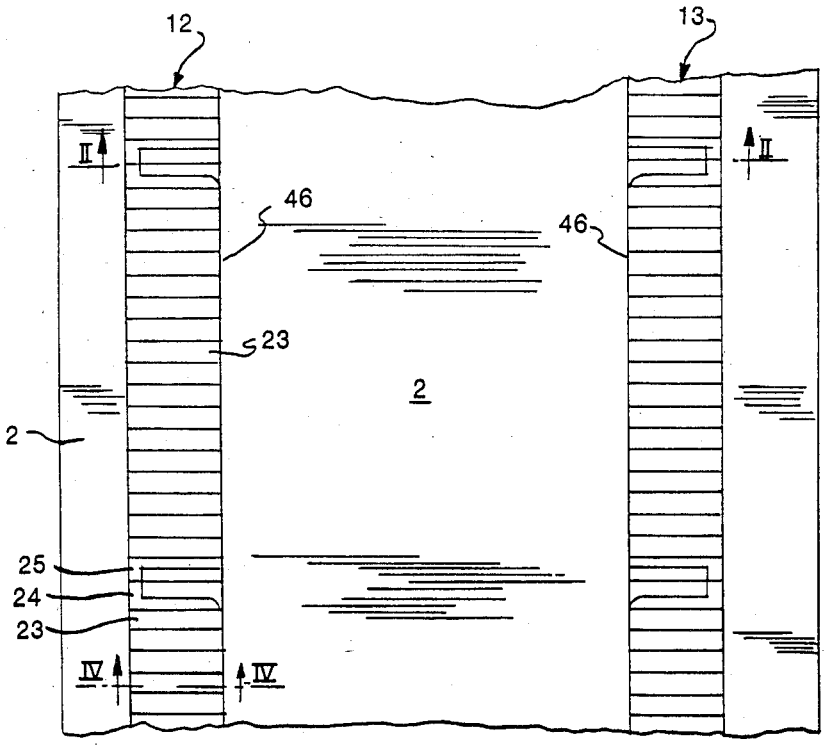
FIG. 3 is a schematic plan view of the elements forming the bottom and the side walls of the molding zone of the apparatus of FIG. 1.

Referring to FIGS. 1–3, the apparatus comprises an upper moving endless belt 1 and a lower moving endless belt 2. The upper belt 1 passes around rolls 3 and 4 and the lower belt 2 passes around rolls 5 and 6. Rolls 3 and 5 are driven in the direction indicated by arrows 10 and 11. Rolls 4 and 6 are driven in the direction of arrows 7 and 8. The rolls drive belt 1 and 2 in the direction of arrows 9. Two moving endless sidedams 12 and 13 (also called dams) are located partly between the lower surface or run of the upper belt 1 and the upper surface of the lower belt 2. The sidedams 12 and 13 define with upper belt 1 and with lower belt 2 a molding zone 12 between an inlet 15 and an outlet 16. In this molding zone the upper surface of the lower belt 2 forms a carrying surface for the casting. The movement of belts 1 and 2 make the sidedams 12 and 13 move in the direction of arrows 9 from inlet 15 to outlet 16 of molding zone 14. In this molding zone the moving sidedams 12 and 13 are carried by the lower belt 2. Downstream of outlet 16, each of the moving sidedams 12 and 13 is carried by a roller guide 17 provided with rolls 18. Upstream of inlet 15 each of the moving dams 12 and 13 is carried by a roller guide 19 provided with rolls 18.

The Belgian Pat. No. 870,907 (U.S. Pat. No. 4,150,711) contains a more detailed description and representation of such guides, which are well known in the art.

The endless moving sidedams 12 and 13 return outside the molding zone 14 from outlet 16 to inlet 15. Along this path, sidedams 12 and 13 are partially guided by guides 17 and 19 and partially by a pushing device 20. The pushing device 20 is described in more detail in the U.S. Pat. Nos. 3,865,176 and 3,955,615. It slightly bends the path of the sidedams.

As detailed in these prior U.S. patents this pushing device removes slack between the blocks of sidedams 12 and 13 in the molding zone 14. These blocks are detailed hereinafter.

The apparatus has a device (not shown) feeding the molding zone 14 with molten material. This feeding device is located at inlet 15 of the molding zone between sidedams 12 and 13 and upstream of roll 3.

The molding zone 14 has a slight downwards sloping inclination from the inlet 15 to the outlet 16. The molten metal, e.g. copper for anodes, that is introduced at inlet 15 of the molding zone, solidifies in this zone before reaching outlet 16. The molten metal is cooled in the molding zone by projecting a cooling liquid on belts 1 and 2, as described in the U.S. Pat. Nos. 3,036,348 and 3,041,686.

At outlet 16 of molding zone 14 the solidified metal appears in the shape of a strip 21, the thickness of which is determined by the distance between belts 1 and 2 and the shape of the side edges of which depend on the shape of the parts of sidedams 12 and 13 facing the molding zone.

Downstream of outlet 16 of molding zone 14, strip 21 is guided in an extension of this zone to a well known cutting device (not shown). This cutting device cuts up the cast strip. The cut up strips may for example be used as anodes.

Both sidedams 12 and 13 are formed by an endless metal strap 22 and by a large number of blocks 23, 24, and 25 slidably strung on this strap. The stringing of blocks on a strap is described in the U.S. Pat. Nos. 3,865,176 and 3,955,615.

Figure 4:
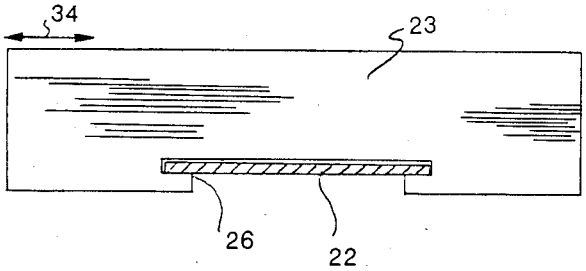
FIG. 4 is an enlarged section taken through a sidewall of FIG. 3, taken along line IV—IV of FIG. 3.

Normal blocks 23, have the general shape of a rectangular parallelepipedon and have at their bottom side a Tee slot 26 in which strap 22 is located, as shown in FIG. 4.

Figure 5:
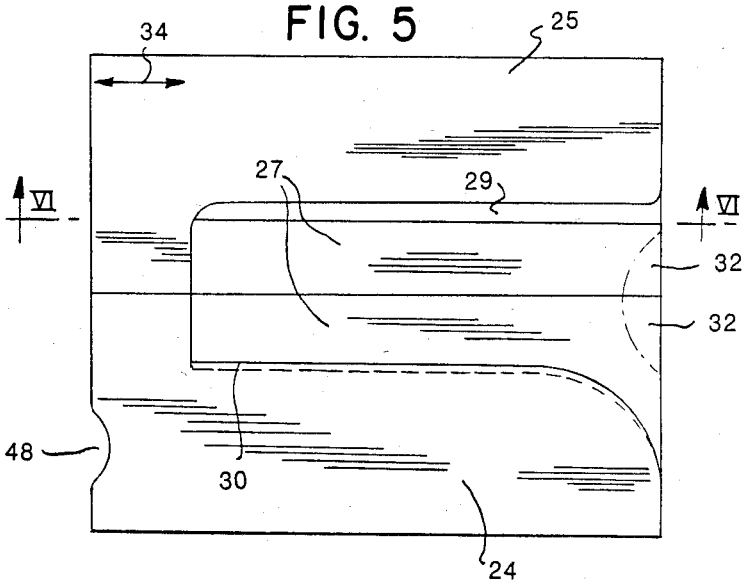
FIG. 5 is an enlarged and more detailed view of part of the left side wall of FIG. 3.
Figure 6:
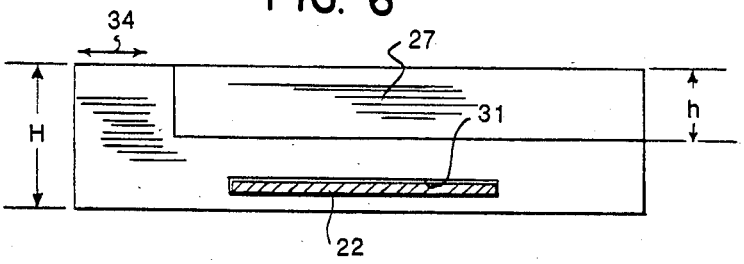
FIG. 6 represents a section through the elements of FIG. 5, taken along line VI—VI of FIG. 5.

Blocks 24 and 25, called lug molding pocket blocks, have a cavity on their upper side turned towards the molding zone 14 and, as shown in FIGS. 5 and 6, together form a molding pocket 27 in which the lugs 28 of strip 21 are cast. The height h of the molding pocket 27 is nearly half the height H of blocks 23, 24, and 25. Edge 29 of pocket 27 may be slightly inclined to facilitate the separation of the cast lugs 28 from the molding pockets. Edge 30 of pocket 27 may also be slightly inclined in the same direction as edge 29 to facilitate the suspension of the products cut off from strip 21. The inclination of edges 29 and 30 is discussed in detail in Belgian Pat. No. 870,907 (U.S. Pat. No. 4,150,711) which will be apparent to those skilled in the art.

The lug molding pocket blocks 24 and 25 have no slot on their bottom side. The bottom side of blocks 24 and 25 forms a continuous flat surface as shown on FIG. 6, strap 22 being located in a slot 31 provided in the lower part of these blocks. Hence during their passage along the molding zone 14, blocks 24 and 25 have their bottom side completely in contact with the upper run of the lower belt 2, ensuring efficient heat transfer and cooling of these blocks 24 and 25. Efficient cooling avoids a rapid deterioration of blocks 24 and 25 caused by the strong thermal strains that they undergo.

It was indeed found that, when using blocks 24 and 25 with a Tee slot of the prior art, the thinnest part of these blocks bends rather rapidly by rising in 32 and 32'. This is not the case with blocks 24 and 25 without the Tee slot that were just described. They have a considerably longer useful life than the lug molding pocket blocks of the prior art.

Figure 7:
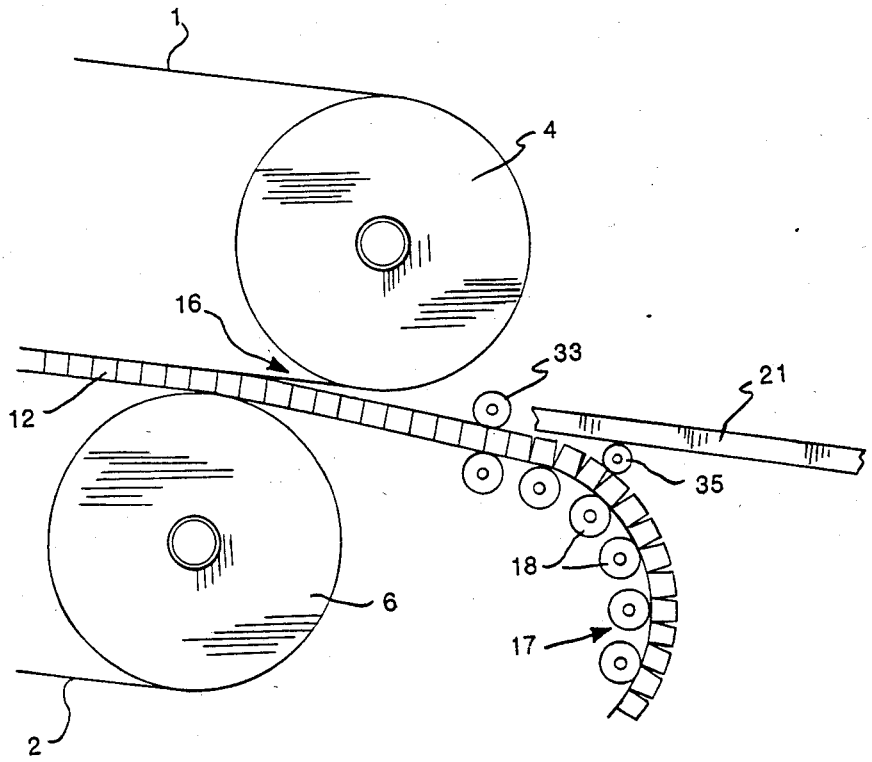
FIG. 7 represents on a larger scale and in a more detailed way the outlet of the apparatus of FIG. 1.
Figure 8:
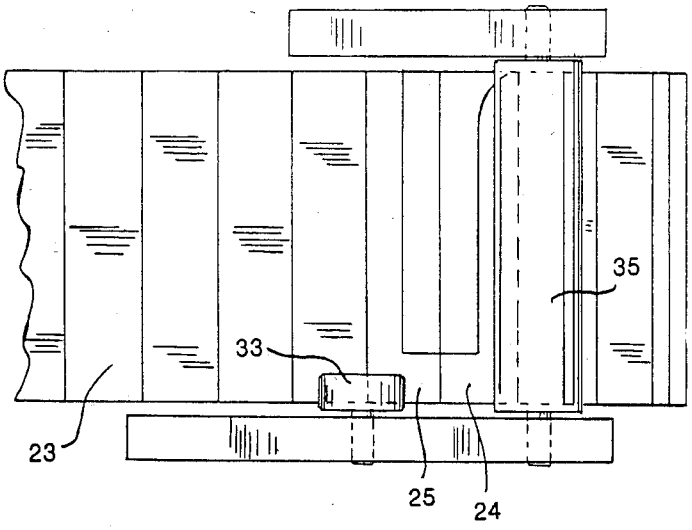
FIG. 8 is a plan view of part of the outlet of FIG. 7.

In order to release the lugs 28 from the molding pockets 27, the sidedams 12 and 13 are guided downwards at outlet 16 of molding zone 14 by roller guide 17, as shown in FIG. 7 and detailed in the aforesaid Belgian Pat. No. 870,907. In order to ensure the separation of lugs 28 from the molding pockets, one or several rollers 33 are placed near outlet 16 of molding zone 14. These roller(s), are also described in the aforementioned Belgian Pat. No. 870,907. They push on the external part, indicated by 34 in FIGS. 4–6, of the upper side of the sidedams 12 and 13, when these dams stick to the lugs 28 and force the sidedams 12 and 13 to separate from lugs 28. The pushing action of roller 33 has a drawback. It makes sidedams 12 and 13, while moving forward on guides 17, occasionally tilt. It was found that it is important to avoid this tilting in order to ensure a smooth forward movement of the sidedam. Otherwise it is very hard to synchronize the forward movement of the sidedams. To avoid this tilting each of sidedams 12 and 13, (preferably as near as possible to the roller 33), has a roller 35 that pushes on the whole width of the sidedam (see FIG. 8) when it has any tendency to tilt.

Reference is again made to FIG. 1. When returning from outlet 16 to inlet 15 of molding zone 14, each of sidedams 12 and 13 passes successively a cooling unit 36, a coating unit 37, a heating unit 38, a unit 39 to measure the temperature of the dam and a unit 40 to detect the passage of lug molding pocket blocks.

Cooling unit 36 comprises a series of sprayers 41, connected by way of an adjustable valve 42 to a source 43 of a cooling fluid such as water and is adapted to project this fluid on the sidedam.

Coating unit 37 comprises two sprayers 44 and 45 connected to a tank (not shown) of an anti-adhesive liquid, i.e. a mold separation agent, and is adapted to project this liquid on the sidedams. Sprayer 44 is adapted to continuously spray on the molding face 46 (see FIG. 3) of the sidedam, while sprayer 45 is directed towards the molding pockets 27 and sprays whenever a pocket 27 passes.

Heating unit 38 comprises a slot burner 47.

Unit 39 comprises a well known very precise sensor (not shown) to measure the temperture of the sidedam which is well known in the art.

Unit 40 comprises a well known detecting device (not shown), adapted to detect the passage of slot 48 in blocks 24 on each side (see FIG. 5).

A detection unit 49, similar to unit 40, is provided downstream of the casting apparatus to detect the passage of the lugs 28 of strip 21.

Information collected by units 39, 40 and 49 is transferred to the computing and control unit 50, treating the information gathered and using the information treated to control the cooling unit 36 and the heating unit 38 so that the casting operation may take place under the most ideal conditions.

Let us suppose that as a strip 21 is cast, the lugs 28 of which have to be disposed symmetrically, the molding pockets 27 of the sidedam 12 are slightly ahead of those of the sidedam 13.

The detection unit 40 of sidedam 13 will have in that case detected the passage of slot 48 somewhat later than detection unit 40 of sidedam 12. The time between both detections is multiplied in unit 50 by the casting speed, which gives the linear lag L1 between the slots of sidedam 12 and sidedam 13 near to inlet 15 of molding zone 14. Unit 50 compares value L1 with a set value L1C and inputs the difference between both values to a first Proportional Action-Integrating Action-Differential Action (PID) regulator that, will use the input data to act on cooling unit 36 of sidedam 12 and/or on cooling unit 36 of sidedam 13 and/or on heating unit 38 of sidedam 12 and/or on heating unit 38 of sidedam 13 in order to eliminate the difference between L1 and L1C. In the present example it will slow down sidedam 12 and/or speed up sidedam 13 until both sidedams are synchronized.

The speed of a sidedam is increased by shortening it and it is shortened by reducing its temperature. The speed of a sidedam is decreased by lengthening it and it is lengthened by increasing its temperature.

In this particular case, namely when sidedam 12 is ahead of sidedam 13, the first PID regulator decreases the flow of the cooling liquid in cooling unit 36 of sidedam 12 and/or increases the flow of the cooling liquid in cooling unit 36 of sidedam 12 and/or increases the temperature in heating unit 38 of sidedam 12 and/or decreases the temperature in heating unit 38 of sidedam 13.

When casting under normal operating conditions, sidedams 12 and 13 are very hot when leaving molding zone 14 and they have to be cooled off by cooling units 36.

At that time the first PID regulator usually acts only on the cooling units 36 to eliminate the difference between L1 and L1C. If this difference is large, the first PID regulator can also act on one of the heating units 38. It may then intensify the cooling of the slower sidedam, stop the cooling of the faster sidedam and start the heating of the latter.

At the beginning of a casting operation, when not yet casting under normal operating conditions, the sidedams are rather cold when they leave molding zone 14 and they do not hae to be cooled off at the cooling units 36. On the contrary, they have to be heated at the heating units 38. At that time, the first PID regulator acts only on heating units 38 to eliminate the difference between L1 and L1C.

Detecting units 49 check if the actions ordered by the first PID regulator have synchronized the sidedams. Let us suppose that lug 38, that was formed in molding pocket 27 of sidedam 12, that was detected at 40, is at 49 a little ahead of lug 28 formed in molding pocket 27 of sidedam 13, that was also detected a moment later in 40 than that of sidedam 12. This means that the actions ordered by the first PID regulator did not completely synchronize the lug casting process. The detection unit 49 of the lugs formed in sidedam 13 will detect the passage of said lug 28 a moment later than detection unit 49 of the lugs formed in sidedam 12. The time between both detections at 49 is multiplied at unit 50 by the casting speed, which gives the linear lag L2 between lug 28 formed in molding pocket 27 of sidedam 12 that was detected at 40 and lug 28 formed in molding pocket 27 of sidedam 13 that was detected a moment later at 40 than that of sidedam 12. Unit 50 compares the value L2 with a set value L2C, that is equal to zero, and inputs the difference between both values to a second PID regulator. The second PID regulator changes the set value L1C so that the actions ordered by the first PID regulator lead to nearly perfect synchronization.

It was found that the additional control in 49 is absolutely necessary to reach a satisfactory synchronization of the sidedams, since the causes of desynchronization are located downstream of the zone in which the correcting action started by molding pocket detection unit 40 acts. Also, the means to eliminate the desynchronization, by differential thermal treatment of the sidedams, responds slowly to actions mandated by the computing and control unit 50.

It is important that the temperature of the sidedams 12 and 13 entering the molding zone 14 should not be lower than about 120° C. so that they are completely dry at that moment. It is also important that said temperature should not be higher than about 200° C. so that sidedams can still contribute substantially to the cooling of the cast metal in the molding zone.

That is the reason why the temperature of each of the sidedams 12 and 13 is measured at the units 39. At unit 50 the average of the temperatures measured in 39 is calculated on a predetermined part of each of the sidedams, for instance on the part delimited by a molding pocket and the fifth molding pocket that follows; this average temperature is compared with a set value and the difference between these two values is made to act on units 36 and 38, while maintaining the temperature difference of both sidedams imposed by the first PID regulator.

The action of sprayer 45 of unit 37 can be ordered by unit 50.

It is obvious that, when casting a strip 21 with symmetric lugs 28, a pair of sidedams will be used which are also symmetric.

Figure 9:
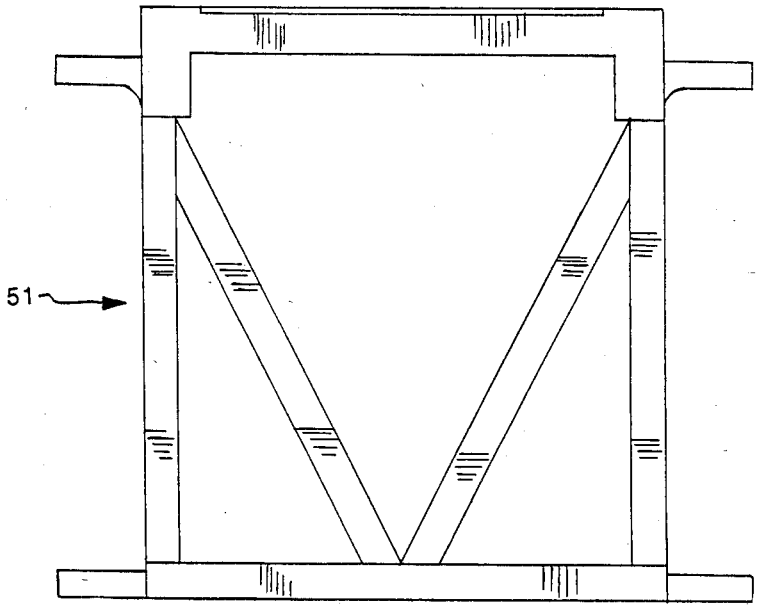
FIG. 9 is a plan view of a starting piece used at the starting of the apparatus of FIG. 1.

It is also obvious that the casting apparatus is started with the sidedams in a perfectly synchronous position. In order to bring the sidedams in this position, a dummy bar 51, shown in FIG. 9, may be used to start casting.

It should be noted that the lug molding pocket blocks, the bottom sides of which comprise flat planes, described before, contribute to the near perfect synchronization, since the lug molding pocket blocks of the prior art easily form casting fins that particularly hamper the separation of the lugs from the pockets.

It should also be noted that the careful coating of the molding block faces forming the sides of the molding zone and the block faces forming the molding pockets with an anti-adhesive agent by units 37 partially contributes the near perfect synchronization, since this coating facilitates the separation of the cast product from the blocks.

It should be understood that the invention is by no means restricted to the above described embodiment and it should not be construed as limiting the scope of the present invention. For instance, the block 25 or normal block 23, following at a given distance block 25, may also be provided with the detection slot 48.

Having thus described our invention, what we claim as new and desire to secure by Letters Patent is:

1. In a process for casting a strip with laterally extending lugs by:

introducing molten metal into the inlet of a molding zone having a bottom and sidewalls, the bottom of the molding zone being formed by the upper surface of a moving endless belt and the sidewalls being formed by a first and second moving endless sidedam, said sidedams moving with the belt from the inlet to the outlet of the molding zone at a predetermined casting speed in linear travel distance per unit of time and returning outside of the molding zone from the outlet to the inlet, each sidedam comprising an endless strap and a multiplicity of blocks strung thereon, some of said blocks forming lug molding pockets, and the height of each pocket being lower than the height of the molding zone;

extracting a cast strip with laterally extending lugs from the outlet of the molding zone;

detecting the passage of lug molding pockets or blocks forming these pockets on each sidedam; and correcting the difference between the temperatures of the first and the second sidedams so as to change the advancing speed of at least one of these dams, a warmer sidedam moving slower than a colder sidedam, if an unwanted lag is found between the molding pockets of the first sidedam and those of the second sidedam;

the improved method of synchronizing the actual positions of the respective cast lugs on opposite edges of the cast strip comprising the steps of:

detecting a first difference in the time of the passage of lug molding pockets or blocks forming these pockets of the first and second sidedams near the inlet of said molding zone;

detecting a second difference in the time of the passage of the laterally extending cast lugs on the opposite edges of the cast strip near the outlet of said molding zone;

multiplying said first time difference by the predetermined casting speed to obtain the value L1 of the linear lag between the respective advancing movements of the pockets of the first and second sidedams;

multiplying said second time difference by the predetermined casting speed to obtain the value L2 of the linear lag between the respective advancing movements of the cast lugs on opposite edges of the cast strip;

comparing the pocket linear lag value L1 with a first predetermined linear lag value L1C and using the difference therebetween as the basis for correcting said difference in temperatures for changing the speed of advancing of at least one of the two sidedams for attempting to synchronize their advancing movements through the molding zone;

comparing the lug linear lag value L2 with a second predetermined linear lag value L2C; and modifying the first predetermined linear lag value L1C as a function of the difference between the lug linear lag value L2 and the second predetermined linear lag value L2C for improving the synchronizing of the respective advancing movements of the cast lugs on opposite edges of the cast strip.

2. The improved method of synchronizing the actual positions of the respective cast lugs on opposite edges of the cast strip as claimed in claim 1, including:

setting said second predetermined linear lag value L2C at zero.

3. The improved method of synchronizing the actual positions of the respective cast lugs on opposite edges of the cast strip as claimed in claim 1, wherein the cast lugs are released from the lug molding pockets near the outlet of the molding zone by guiding the sidedams downwardly and by pushing downwardly on an external part of the sidedam blocks forming the lug molding pockets and wherein the sidedams occasionally tilt as a result of such downward pushing, including the further step of:

pushing downwardly on the whole width of each sidedam immediately after the sidedam has moved downwardly away from the cast strip for avoiding such tilting for thereby assuring smooth advancing movements of the sidedams for facilitating their desired synchronization.

4. The improved method of synchronizing the actual positions of the respective cast lugs on opposite edges of the cast strip as claimed in claim 1, including the further steps of:

measuring the temperatures of said sidedams prior to the entry of said sidedams into the inlet of said molding zone; and selectively controlling the temperatures of said sidedams by heating or cooling said sidedams in response to said measuring step for keeping said measured temperatures of said sidedams within the range of 120° C. to 200° C.

5. The improved method of synchronizing the actual positions of the respective cast lugs on opposite edges of the cast strip as claimed in claim 4, including:

setting said second predetermined linear lag value L2C at zero.

6. The improved method of synchronizing the actual positions of the respective cast lugs on opposite edges of the cast strip as claimed in claim 1, including the step of:

increasing the heat transfer between said blocks forming said pockets on each sidedam and said endless belt by providing each of the sidedam blocks forming said lug molding pockets with a continuous flat, planar bottom surface which surface comes into intimate heat transfer contact with said belt while moving through said molding zone.

7. The improved method of synchronizing the actual positions of the respective cast lugs on opposite edges of the cast strip as claimed in claim 4, including the step of:

increasing the heat transfer between said blocks forming said pockets on each sidedam and said endless belt by providing each of the sidedam blocks forming said lug molding pockets with a continuous flat, planar bottom surface which surface comes into intimate heat transfer contact with said belt while moving through the molding zone.

8. An apparatus for casting a strip with laterally extending lugs by introducing molten metal into the inlet of a molding zone having a bottom and sidewalls, the bottom of the molding zone being formed by the upper surface of a moving endless belt and the sidewalls being formed by a first and second moving endless sidedam, said sidedams moving with the belt from the inlet to the outlet of the molding zone at a predetermined speed in linear travel distance per unit of time and returning outside of the molding zone from the outlet to the inlet, each sidedam comprising an endless strap and a multiplicity of blocks strung thereon, some of said blocks forming lug molding pockets, and the height of each pocket being lower than the height of the molding zone, and wherein the cast strip with laterally extending lugs on each edge is extracted from the outlet of the molding zone, including means for detecting the passage of lug molding pockets or blocks forming these pockets on each sidedam, and cooling means for correcting the difference between the temperature of the first and the second sidedams so as to change the advancing speed of at least one of these dams, a warmer sidedam moving slower than a colder sidedam, if an unwanted lag is found between the molding pockets of the first sidedam and those of the second sidedam, apparatus for synchronizing the actual positions of the respective cast lugs on opposite edges of the cast strip comprising:

first detecting means for detecting a first difference in the time of the passage of lug molding pockets or blocks forming these pockets of the first and second sidedams near the inlet of said molding zone;

second detecting means for detecting a second difference in the time of the passage of the laterally extending cast lugs on the opposite edges of the cast strip near the outlet of said molding zone;

heating means for heating each of said sidedams;

control means for controlling said heating and cooling means, said first and second detecting means being connected to said control means, said control means including multiplying means for multiplying said first time difference by the predetermined casting speed to obtain the value L1 of the linear lag between the respective advancing movements of the pockets of the first and second sidedams and for multiplying said second time difference by the predetermined casting speed to obtain the value L2 of the linear lag between the respective advancing movements of the cast lugs on opposite edges of the cast strip;

said control means including comparator means for comparing the pocket linear lag value L1 with a first predetermined linear lag value L1C, said control means using the difference therebetween as the basis for controlling said heating means and said cooling means for correcting said difference in temperatures for changing the speed of advancing of at least one of the two sidedams for attempting to synchronize their advancing movements through the molding zone;

said control means including second comparator means for comparing the lug linear lag value L2 with a second predetermined linear lag value L2C; and said control means modifying the first predetermined linear lag value L1C as a function of the difference between the lug linear lag value L2 and the second predetermined linear lag value L2C for improving the synchronizing of the respective advancing movements of the cast lugs on opposite sides of the cast strip.

9. Apparatus for synchronizing the actual positions of the respective cast lugs on opposite edges of the cast strip as claimed in claim 8, including:

means for increasing the heat transfer between said blocks forming said pockets on each sidedam and said endless belt while said blocks and said belt are moving through said molding zone comprising a continuous flat, planar bottom surface on said blocks which surface comes into intimate heat transfer contact with said belt while moving through said molding zone.

10. Apparatus for synchronizing the actual positions of the respective cast lugs on opposite edges of the cast strip as claimed in claim 8, including:

means for measuring the temperatures of said sidedams prior to the entry of said sidedams into the inlet of said molding zone; and said measuring means being connected to said control means for selectively controlling said heating means and said cooling means for controlling the temperatures of said sidedams by heating or cooling said sidedams in response to said measuring step for keeping said measured temperatures of said sidedams within the range of 120° C. to 200° C.

11. Apparatus for synchronizing the actual positions of the respective cast lugs on opposite edges of the cast strip as claimed in claim 10, in which:

said blocks which form the lug molding pockets have continuous flat, planar bottom surfaces for increasing the heat transfer between said blocks and said endless belt, and said bottom surfaces of said blocks come into intimate temperature exchange contact with said endless belt while said sidedams are moving with the belt from the inlet to the outlet of the molding zone.

12. In apparatus for casting a strip with laterally extending lugs by introducing molten metal into the inlet of a molding zone having a bottom and sidewalls, the bottom of the molding zone being formed by the upper surface of a moving endless belt and the sidewalls being formed by a first and second moving endless sidedam, said sidedams moving with the belt from the inlet to the outlet of the molding zone and returning outside of the molding zone from the outlet to the inlet, each of these sidedams comprising an endless strap and a multiplicity of blocks strung thereon, some of these blocks forming lug molding pockets, and the height of each pocket being lower than that of the molding zone and wherein the cast strip with laterally extending lugs is extracted from the outlet of the molding zone, apparatus for synchronizing the actual positions of the respective cast lugs on opposite edges of the cast strip comprising:

first means to detect the passage of a corresponding pair of said pockets or the blocks forming these pockets in said first and second sidedams at a point along their path of travel prior to entry to said inlet of said molding zone, heating and cooling means for correcting for changes in temperature between said first and second sidedams which in effect control the speed of travel of said sidedams;

control means for controlling said heating and cooling means;

second means to detect the passage of lugs of the cast product at the outlet of said molding zone;

temperature measuring for giving type measuring the temperature of said sidedams;

a means for coupling said first means to said control means for controlling the speed of said sidedams in response to mold pocket positions in said sidedams;

means for coupling said second means to said control means for modifying said speed of said sidedams set in response to said first means;

and means for coupling said temperature means to said control means for maintaining the temperature of said sidedams within a predetermined range while the speed of said sidedams is being controlled in response to said first and second means.

* * * * *